United States Patent [19]

Kachelries

[11] 4,385,821

[45] May 31, 1983

[54] AUTOMATIC VELOCITY AND POSITION CONTROLLER FOR A FILM PROCESSOR

[75] Inventor: Robert W. Kachelries, West Goshen, Pa.

[73] Assignee: E. I. Du Pont de Nemours and Company, Wilmington, Del.

[21] Appl. No.: 136,805

[22] Filed: Apr. 3, 1980

[51] Int. Cl.[3] ..... G03D 13/00

[52] U.S. Cl. ..... 354/319; 318/616

[58] Field of Search ..... 354/297, 298, 319–322, 354/314; 318/561, 616–618, 715

[56] References Cited

U.S. PATENT DOCUMENTS

| | | | |
|---|---|---|---|
| 3,081,961 | 3/1963 | Kron | 242/75.47 |
| 3,623,416 | 11/1971 | Anderberg | 95/93 |
| 3,657,524 | 4/1972 | Bakke | 318/561 X |
| 3,828,168 | 8/1974 | O'Callaghan et al. | 318/616 X |
| 3,913,119 | 10/1975 | Pfeifer | 354/298 |
| 4,057,818 | 11/1977 | Gaskell et al. | 354/298 |
| 4,065,703 | 12/1977 | Schlicher et al. | 318/715 X |
| 4,156,569 | 11/1979 | Fasano | 354/322 |
| 4,219,765 | 8/1980 | Morsing | 318/616 X |
| 4,229,684 | 10/1980 | Saglini et al. | 318/561 |

FOREIGN PATENT DOCUMENTS 1418523 11/1975 United Kingdom .

*Primary Examiner*—G. Z. Rubinson
*Assistant Examiner*—W. J. Brady

[57] ABSTRACT

An automatic controller for a film processor is characterized by a motor energy signal generator which is responsive to both a position error signal and to a velocity error signal. The motor energy signal is periodically applied to a drive motor for the processor to modify the portion of the available energy transmitted from a source to the motor to restore the actual film position to within a predetermined range of an ideal film position and to restore the actual velocity of the film to within a predetermined range of an ideal film velocity.

12 Claims, 16 Drawing Figures

20
Fluid Level
30
Exit
55
52
Blower
42
Motor
44
Wash
28
Fixer
26
Dev. 2
25
Dev. 1
24
24A
24B
Fixer Repl. Tank
36
Dev. Repl. Tank
34
40
38
48
51
56
54
50
46
22A
70
76
84
88
82
86
74
78
114
104
100
90
92
102
106
80
ΔS

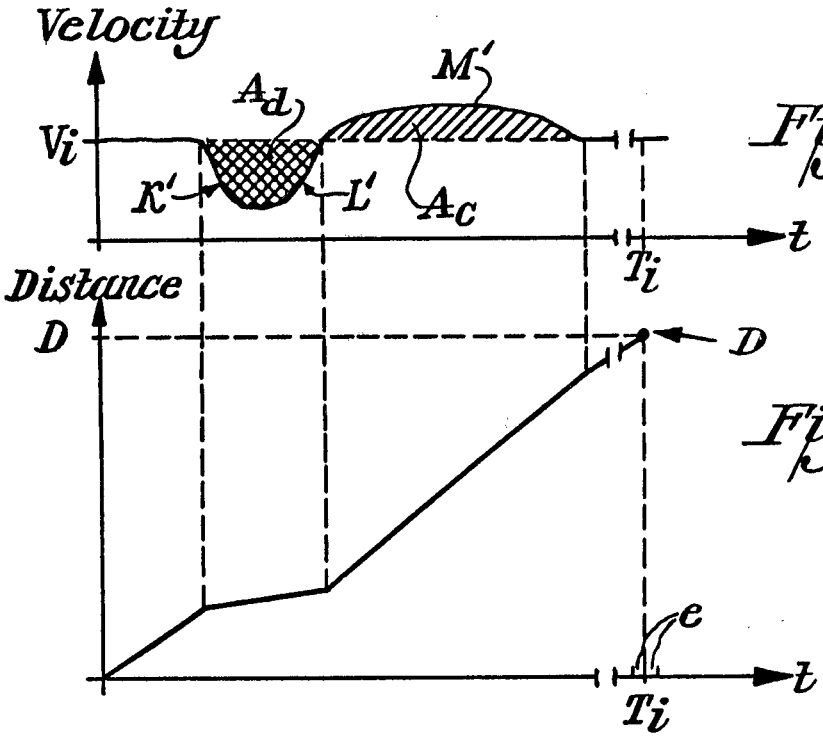
Fig.6A.
Fig.6B.
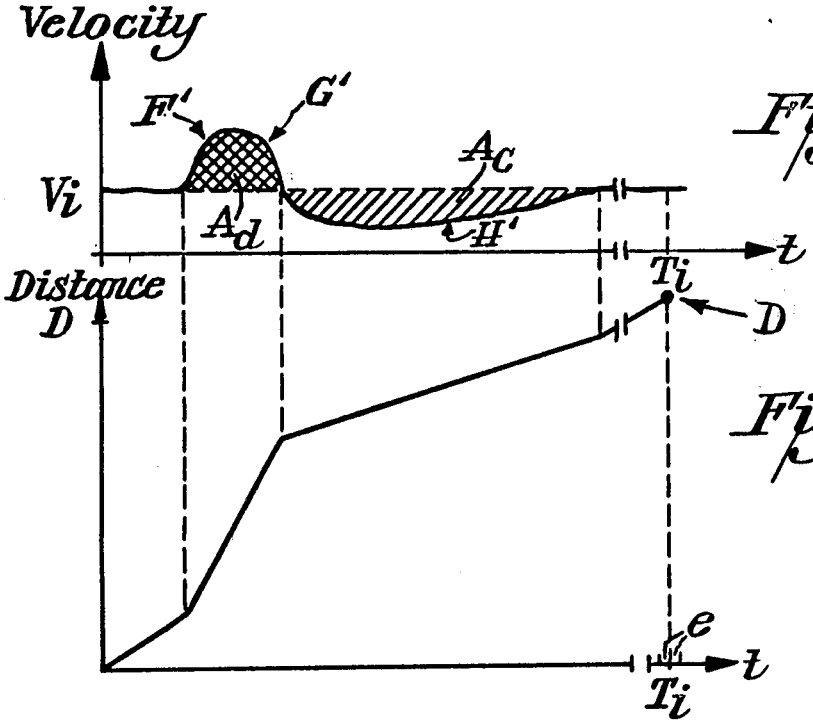
Fig.5A.
Fig.5B.

100
From Sensor 82
90
From Front Panel
102
92
Ti
Set Point Generator
116
117E
117S
117R
119
Reference Signal Generator
120
Error Correction Interval Signal Generator
128
122E
238
Velocity Error Signal Generator
126
122V
90V
299
135V
Position Error Signal Generator
124
122P
90P
90S
Speed Change Control Network
118
117S
119
121
238
299
Kp·Pe(t)
132
Motor Energy Signal Generator
130
134
Kv·Ve(t)
138M
ΔI
To Motor Control
78
114
104
From 106

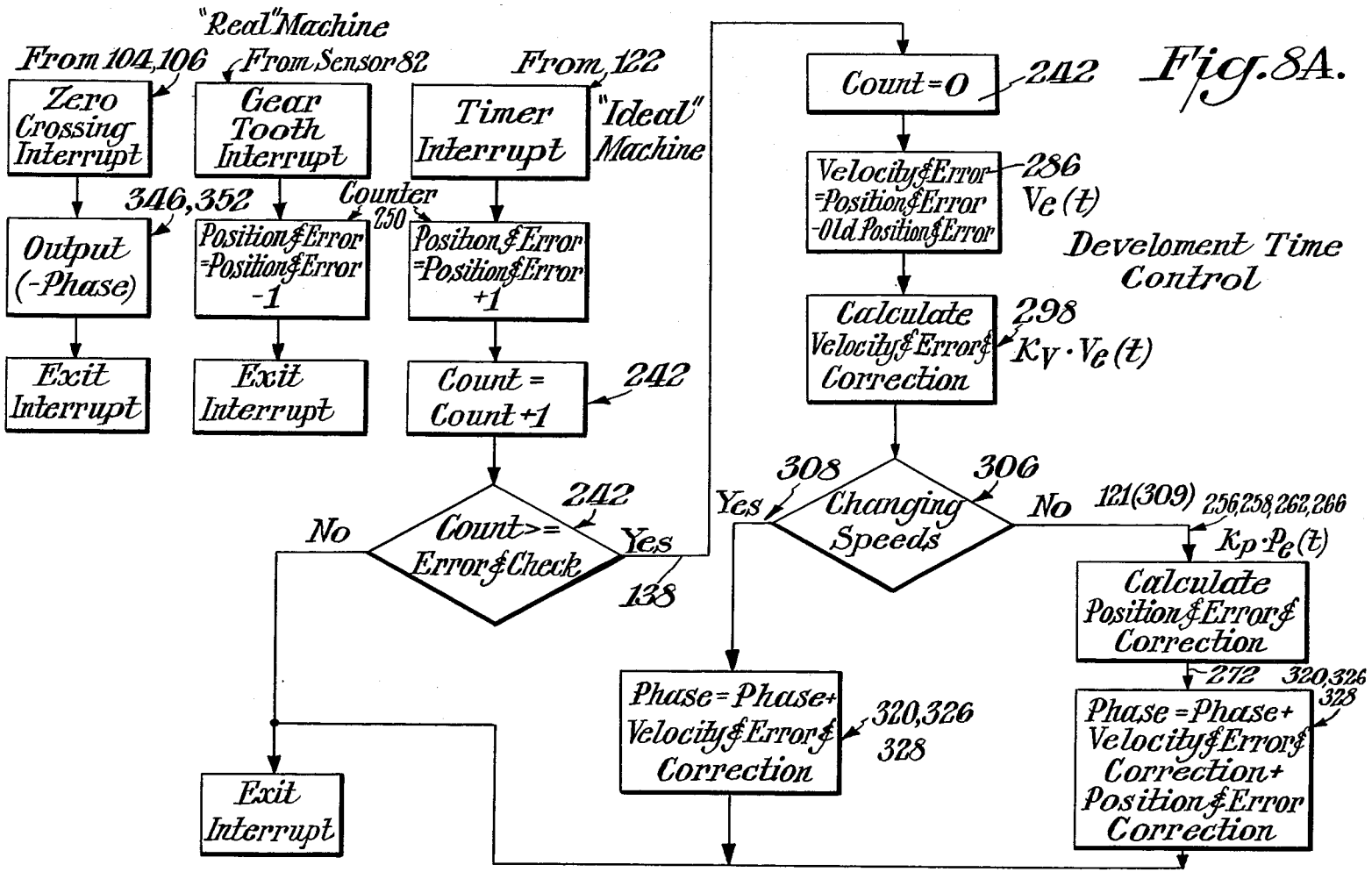
Fig. 8A.
Development Time Control
"Real" Machine
From 104,106
Zero Crossing Interrupt
346,352
Output (-Phase)
Exit Interrupt
From Sensor 82
Gear Tooth Interrupt
Counter 250
Position & Error = Position & Error -1
Exit Interrupt
From 122
"Ideal" Machine
Timer Interrupt
Position & Error = Position & Error +1
242
Count = Count +1
242
Count >= Error & Check
Yes
138
No
Exit Interrupt
242
Count = 0
286
Velocity & Error = Position & Error - Old Position & Error
298
Calculate Velocity & Error & Correction
$K_V \cdot V_e(t)$
306
Changing Speeds
No
121(309)
256,258,262,266
$K_p \cdot P_e(t)$
Calculate Position & Error & Correction
272
320,326
328
Phase = Phase + Velocity & Error & Correction + Position & Error Correction
308
Yes
320,326
328
Phase = Phase + Velocity & Error & Correction 90V/90P
122N
122P
121
124
126
130
132
135
138V-1
138V-2
138M-1
138M-2
Sum Err
Kp·Pe(t)
Kv·Ve(t)
Ve(t)
Em(t)
Kp
Kv
270H
270L
Motor Energy Signal
CLK
A.C.
78
80
100
104
106
111
282
282A
282B
284
286
292
294
295
298
299
300
302
305
320
322
324
326
328
330
332
334
336H
336L
342
344
346
350
352
353
360
362
366
370
376
378
380
250
252
254
258
260
262
264
266
270
272

AUTOMATIC VELOCITY AND POSITION CONTROLLER FOR A FILM PROCESSOR

BACKGROUND OF THE INVENTION

1. Field of the Invention

This invention relates to an automatic controller for a film processor having a motor driven film transport roller arrangement and, in particular, to an automatic controller which utilizes both a position error signal and a velocity error signal to control the motor drive for the film transport rollers.

2. Description of the Prior Art

A film processor which includes coupled developing, fixing, washing and drying sections is well known. In such an apparatus, a film to be processed is introduced into the processor and is conveyed along a predetermined path through the processor by an arrangement of film transport rollers. The rollers are driven through a geared interconnection by a drive motor. Thus, the film is advanced on the rollers through the processor at a velocity that is functionally related to the velocity of rotation of the roller drive motor.

It is in the first two sections of the processor (developing and fixing) that the various chemical reactions occur which develop and fix the image of the exposed film. Due to the nature of the chemical reactions within the developing section of the processor, it is important to closely control the time interval (called "development time") during which the exposed film remains within the developing section of the processor. Much less criticality attaches to time that the film remains within the fixing, washing and drying sections. If the film should remain within the developing section for a period in excess of the development time, overdevelopment may occur. Conversely, the film may be underdeveloped if it remains in these sections for less than the desired development time. Both situations are not advantageous (if it is assumed that the development bath temperature and development chemical activity are within operative limits).

Since the portion of the predetermined path of the film that lies within the developing section of the processor is a fixed distance, and since the optimum development time for each film is known, it has been the practice to attempt to maintain the duration of film residency within the developing section to within predetermined close ranges of the development time by controlling the velocity at which the film is conveyed through the developing section. This velocity control for the film is usually accomplished by controlling the energy flow to the drive motor for the film transport rollers. The circuitry to effect this motor control function usually utilizes a signal, derived from a sensor disposed in proximity to a toothed wheel rotating in a functional relationship with the motor rotation, to generate a motor control feedback signal. The information derived from this sensor (which is representative of the film's position within the processor) is converted to a signal representative of measured film velocity. When the motor speed causes the film to deviate from the predetermined velocity, the motor control network operates to restore the film velocity to the predetermined velocity.

The rationality underlying the fixed velocity approach may be understood by reference to FIGS. 1A and 1B, which depict the ideal velocity-time and the distance-time relationships of known film processors.

The reasoning underlying this technique relies upon the facts that the optimum or ideal development time $T_i$ is a known quantity, and that the distance D through which the film must be transported through the developing section is also known. Thus, if the motor is driven so as to transport the film at a constant, ideal velocity $V_i$, after the expiration of the ideal development time $T_i$, the film will have been transported the distance D through the developing section.

As a corollary to this principle, if, for whatever reason, the velocity at which the film is moving through the processor should deviate from the ideal velocity $V_i$, appropriate corrective action is taken by the present motor drive control to return the film velocity to the ideal velocity $V_i$. This response of the present motor drive control is graphically depicted in FIGS. 2A and 2B and FIGS. 3A and 3B, all of which depict approximations of the measured actual velocity-time and of the distance-time relationships for known film processors.

In the instance illustrated by the dotted points in FIG. 2A, the occurrence of some defect may cause a perturbation in the film transport velocity which increases the velocity of the film above the reference level $V_i$. This effect is shown in the region of FIG. 2A indicated by reference character F. The motor control circuit associated with the drive motor derives an indication of this velocity increase from the toothed gear transducer and responds to the deviation by controlling the motor to cause the film velocity to return to the predetermined velocity $V_i$, the correction being depicted in the region of FIG. 2A indicated by the reference character G. In some instances, a slight opposite deviation may occur, illustrated by the reference character H, but this overcompensation is usually relatively quickly damped by the system.

Another possible instance is illustrated by the starred points in FIG. 3A. If another perturbation occurs to decrease the actual velocity below the reference velocity $V_i$ (as in the region indicated at K in FIG. 3A), the velocity control arrangement derives an indication of this velocity decrease from the toothed gear transducer and acts so as to return the actual velocity toward the reference $V_i$ (as indicated in FIG. 3A at reference character L). Some overcompensation may occur, as at M, but this overcompensation is incidental to the response of the system and is relatively quickly damped. (Of course, it is understood that either or both types of perturbations may occur many times during the passage of any given film through the processor, and that the effect of the perturbation and the response of the prior motor control system are separately shown in FIGS. 2 and 3 for clarity of analysis.)

The effects of the perturbations in film velocity and of the actions of the motor control in response to these perturbations (regions F, G and H in FIG. 2A and regions K, L, and M in FIG. 3A) in terms of film residency in the development section are shown in FIGS. 2B and 3B, respectively.

In FIG. 2B, in the case of a velocity increasing perturbation (region F) the response of the motor control (regions G and, perhaps, H) is only to return the film velocity to the predetermined ideal velocity $V_i$. As a result, however, the film reaches the distance D (i.e., it is traversed through the developing section) at the time $T_i - t_1$. And, at the time $T_i$, the film has traversed a distance $D + d_1$, where the distance $D + d_1$ is beyond the developing section. Put alternately, since the film traversed the development distance D in a time less than the optimum development time $T_i$, the film is likely to be underdeveloped.

Conversely, as is shown in FIG. 3B, in the case of an actual velocity decrease (region K) the response of the motor control (regions L and, perhaps, M) is again only to return the actual film velocity to the predetermined ideal velocity $V_i$. As a consequence, at the time $T_i$, the film has not yet traversed the full distance D but has been moved only through the distance $D-d_2$. Stated alternately, the film will not traverse the full development distance D until a time $T_i+t_2$, which time is after the expiration of the optimum development time $T_i$. Since the film remains within the developing section for a time longer than the optimum development time $T_i$, the film is likely to be overdeveloped.

The disadvantages of overdevelopment and underdevelopment are believed to be caused by the response of the prior motor control systems in correcting only for velocity errors (deviations of measured actual velocity from the ideal velocity $V_i$). Since it is critical to insure that the film occupy a position precisely at the exit of the developing section at precisely the idea time $T_i$, and since with the prior (fixed velocity) motor control arrangements the deviation between the actual position of the film with respect to an ideal reference position (at any instant) goes uncorrected, it is believed that a fixed velocity motor control system as is used in the art is not totally desirable in the context of film processors. With such control systems, the increase or decrease in the actual position of the film within the developing section of the processor with respect to the ideal film position that the film should occupy were it not deviated from the ideal velocity goes uncompensated. Thus, although position information is available to the known film processors, this position information is not used when compensating for velocity perturbations.

It is believed to be advantageous to provide an automatic controller for a film processor which corrects for a velocity perturbation by not only returning the film velocity to the reference ideal velocity but also by returning the film to the ideal position it would have occupied but for the velocity perturbation so that optimum development time can be achieved. To accomplish this purpose, it is believed advantageous to generate a total motor error signal which is functionally related to both an error signal representative of the position error (representative of the difference in position between measured actual film position and an ideal reference position) and a velocity error signal (representative of the difference in actual film velocity and ideal film velocity). Further, it is believed to be advantageous to utilize the total motor error signal to generate a motor energy signal which may be applied to the motor to modify the amount of energy that is applied to the motor. Moreover, it is believed advantageous to periodically apply the motor energy signal in a manner that distributes the corrective action over a longer time period, rather than compensating for the effects of the velocity perturbation in the same time period as occupied by the perturbation. Although the invention may be implemented in both a hardwire analog or a hardwire digital mode, it is believed advantageous to practice the invention with a programmed digital computer, preferably a firmware-based, microcomputer arrangement.

SUMMARY OF THE INVENTION

This invention relates to an automatic controller for a film processor of the type that advances film to be processed on transport rollers along a fixed-length path through the developing section of the processor in accordance with the speed of rotation of the transport roller drive motor. The automatic controller generates a motor energy signal which is periodically applied to the motor. The motor energy signal is the summation (or time integration) of the total motor error signal. The total motor error signal is a function of both the position error (difference between measured actual position and ideal reference position) and the velocity error (change in position error per unit time). The motor energy signal may be applied to a motor control network to modify the amount of available energy that will be permitted to be applied to the motor. The motor energy signal modifies motor speed to correct for perturbations in film velocity which cause the actual film velocity and measured actual film position to deviate from an optimum ideal velocity and from an ideal position. The total motor error signal appropriately increases or decreases the motor energy signal which, in turn, increases or decreases the actual velocity of the roller drive motor not only to return the motor (and the film) to a predetermined ideal reference velocity but also to compensate and to restore the actual position of the film to the ideal reference position. In the preferred embodiment, the motor energy signal is periodically applied in synchronization with the line signal to modify the portion of line power applied to the motor. The automatic controller in accordance with this invention is preferably implemented using a firmware based microcomputer, although the invention may be implemented with a general purpose digital computer operating in accordance with a program or in analog or digital modes in a hardwired circuit arrangement.

BRIEF DESCRIPTION OF THE DRAWINGS

The invention may be more fully understood from the following detailed description thereof taken in connection with the accompanying drawings, which form a part of this application and in which:

FIGS. 5A and 5B and FIGS. 6A and 6B are approximate plots illustrating the operating response of an automatic controller in accordance with the instant invention when deviations occur in the measured actual velocity of a film;

FIGS. 8A and 8B are a flow chart illustrating a program by which the instant invention may be implemented by a microcomputer;

DETAILED DESCRIPTION OF THE INVENTION

Figure 2A:
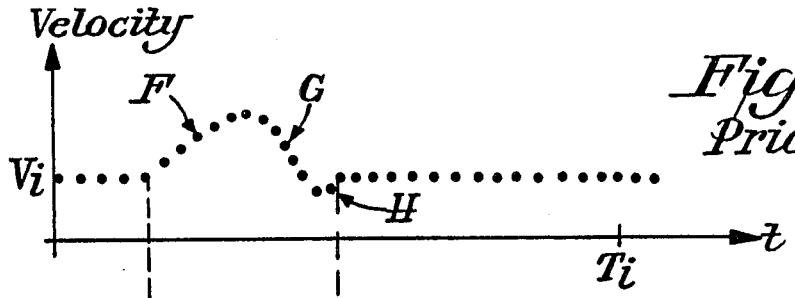
Fig. 2A. Prior Art
FIGS. 2A and 2B, and FIGS. 3A and 3B are approximate plots illustrating the operating response of prior art fixed velocity controllers when deviations occur in the measured actual velocity of the film in prior art film processors.

Throughout the following detailed description, similar reference numerals refer to similar elements in all Figures of the drawings.

Figure 4:
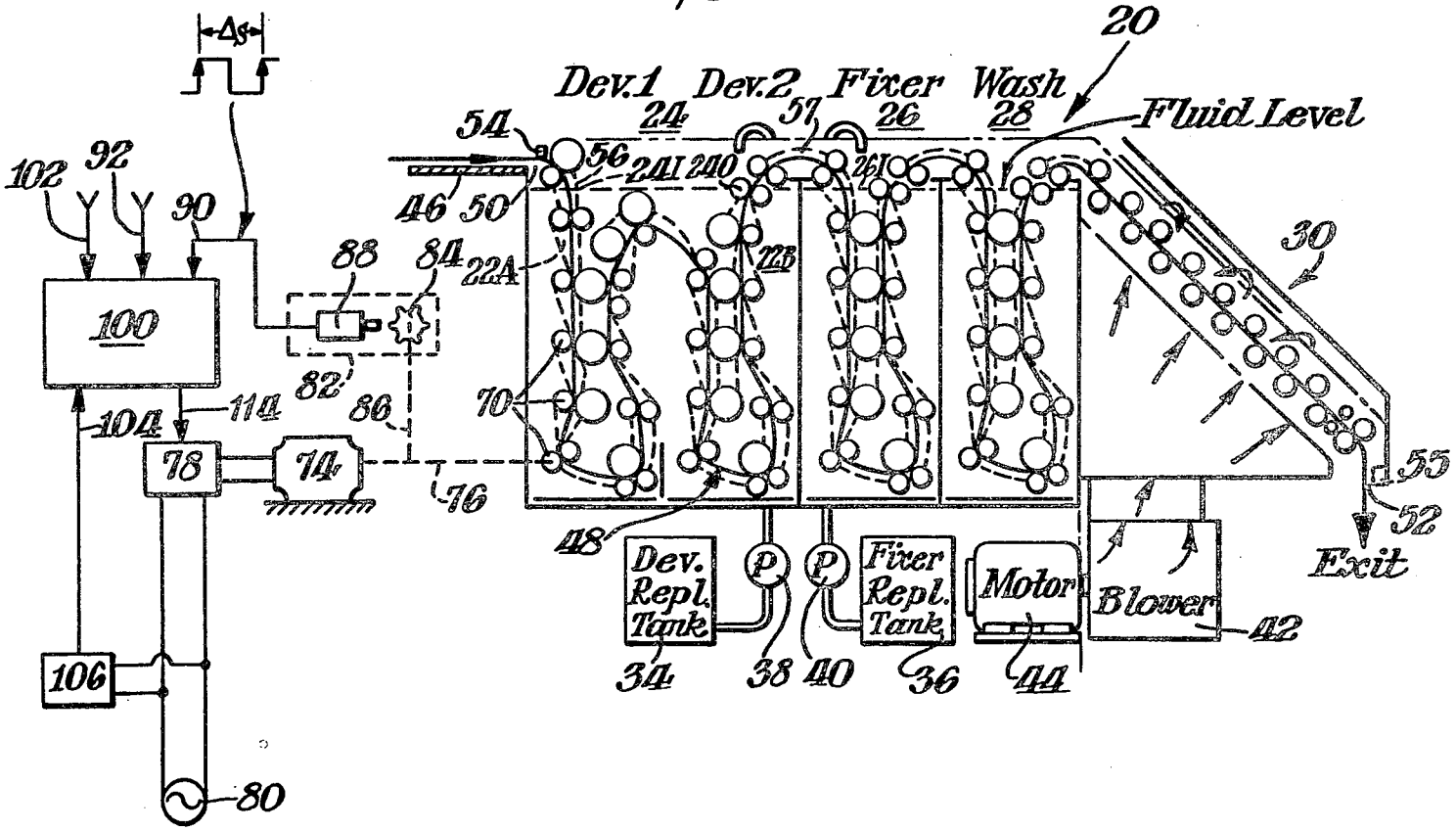
FIG. 4 is a stylized pictorial representation indicating the various elements of a film processor and the interconnection therewith by an automatic controller in accordance with the instant invention.

FIG. 4 is a stylized pictorial representation of the elements of a film processor generally indicated by reference character 20 and the interconnection therewith by an automatic controller 100 in accordance with the instant invention. The processor 20 includes coupled developing tanks 22A and 22B which cooperate to define a developing section 24, a fixing section 26, a washing section 28 and a drying section 30. The appropriate liquid level within each of the sections 24 and 26 is maintained by resupply from a replenishment tank 34 (developer liquid) and a replenishment tank 36 (fixer liquid) through associated pumps 38 and 40, respectively, and piping. Heat is supplied to the drying section 30 from a blower 42. Power for the pumps 38 and 40 and for the blower 42 is derived from separate motor drives, as for example, the blower drive motor 44.

Exposed film to be processed is introduced into the processor 20 on a suitable feed table 46 and is conveyed serially through each of the sections along a generally serpentine path 48 defined between the film inlet 50 to the film outlet 52. A film sensor switch 54 is disposed near the film inlet 50. The output signal from the sensor switch 54 is utilized by a suitable circuit network (not shown) to generate a second signal representative of the exit of the film from the processor. This circuit network provides the functional equivalent of a film sensor switch (as a switch 55) which may be disposed adjacent the film outlet of the processor.

A predetermined clearance distance 56 is defined between the film inlet 50 and the level of the developing liquid in the developing section 24. A density detecting arrangement is located adjacent the film outlet 52 in the drying section 30. The film sensor switch 54 and the density detecting arrangement provide information useful in a reference background monitoring network the details of which are disclosed in the copending application of Robert W. Kachelries entitled Automatic Reference Background Monitoring Network for a Film Processor, Ser. No. 136,806 now U.S. Pat. No. 4,345,831 filed Apr. 3, 1980 concurrently herewith.

The exposed film is conveyed along the serpentine path 48 through the processor 20 on an array of transport rollers 70. Due to the fixed disposition of the rollers 70, the total length of the serpentine path 48 that the film follows through the processor is known. Moreover, that portion of the film's total path 48 that lies beneath the level of the liquid in the developing section (indicated by characters 24I and 24O) is also relatively accurately known as well as the "wet distance" 57 between the point 24I and the point 26I at which the film enters the fixing path. This portion of the film's path (i.e., the portion of the path 48 during which the film is in contact with liquid developer and defined by the distance from the point 24I to the point 26I) is hereafter referred to as the "development distance D" or by the reference character "D". It is as the film is transported along the development distance D that the exposed film is subjected to chemical action brought about by the temperature controlled, filtered and agitated developer liquid disposed within the developing section 24.

The transport rolls 70 advance the film through the processor 20, and particularly through the development distance D, in accordance with the speed of rotation of a drive motor 74 operatively coupled to the rollers 70 through a mechanical linkage 76. The operation of the drive motor 74 is controlled by a motor control network generally indicated by reference character 78. The motor control network 78 serves to control the speed of the motor 74 by selectively regulating the amount of power output from a source 80 that is applied to the motor 74. In the preferred embodiment of the invention, the motor 74 is a D.C. motor. In that event the motor control network 78 may conveniently include a full wave, phase-fired, silicon controlled rectifier (SCR) unit adapted to rectify an A.C. line signal, typically a 220 volt, 60 Hertz A.C. signal.

Since the length of the development distance D is known, it is possible to derive an indication of the actual position of the film along the development distance D. To measure and to provide information regarding the actual position of the film along the development distance D and, implicitly, information regarding the actual film velocity as the film is transported through the developing section 24, a sensor arrangement 82 is provided. In the preferred embodiment of the invention, the sensor arrangement 82 includes a toothed gear wheel 84 operatively linked to the output shaft of the motor 74 by a linkage 86. The gearing ratio between the motor 74 and the gear 84 is not critical, so long as the relationship between the development distance D and the number of teeth on the gear wheel 84 is known. A suitable pickup 88, such as a Hall effect sensor responds to the passage of each tooth on the gear wheel 84 to generate a square wave pulse train. The occurrence of two adjacent rising edges of pulses in the train represents a predetermined displacement $\Delta s$ of the film along the development distance D within the developing section. This output signal, explicitly containing information relating to the measured actual position of the film and implicity containing information relating to the actual film velocity, is output to the automatic controller 100 on a line 90.

In accordance with the instant invention, information regarding the entry and exit of the film from the processor 20 is also applied over lines 92 to the controller 100. The signals on the lines 92 are derived from the switch 54 and the circuit equivalent of the switch 55.

The controller 100 is also provided with information representative of the ideal, or reference, position (or velocity) that a film must exhibit in order to move through the development distance D within the development section 24 in a time substantially equal to the optimum or ideal development time $T_i$. This ideal development time information is applied to the processor 100 on a line 102 from the front control panel (not shown) of processor 20 and is generally defined in terms of the ideal film development time $T_i$. That is to say, the input 102 to the controller 100 is chosen by an operator through the agency of a front panel selection of an adjustable ideal development time $T_i$.

The controller 100 responds to the information relating to the measured actual film position (and actual film velocity) carried on the line 90 and to the ideal position and velocity information implicit in the ideal time signal applied on the line 102 to generate a motor energy control signal which is applied to the motor control network 78. The motor energy signal is applied to the motor control 78 over a line 114. The manner in which the motor energy signal is generated is discussed in full detail herein.

In some instances, it may be desirable to synchronize the application of the motor energy signal from the controller 100 to the motor control network 78. Accordingly, to facilitate this synchronization, the controller 100 receives as an input a synchronizing signal carried on a line 104 from a controller interrupt signal generator 106. In most instances, the signal generator 106 takes the form of a zero crossing detector network.

Figures 3A, 3B:
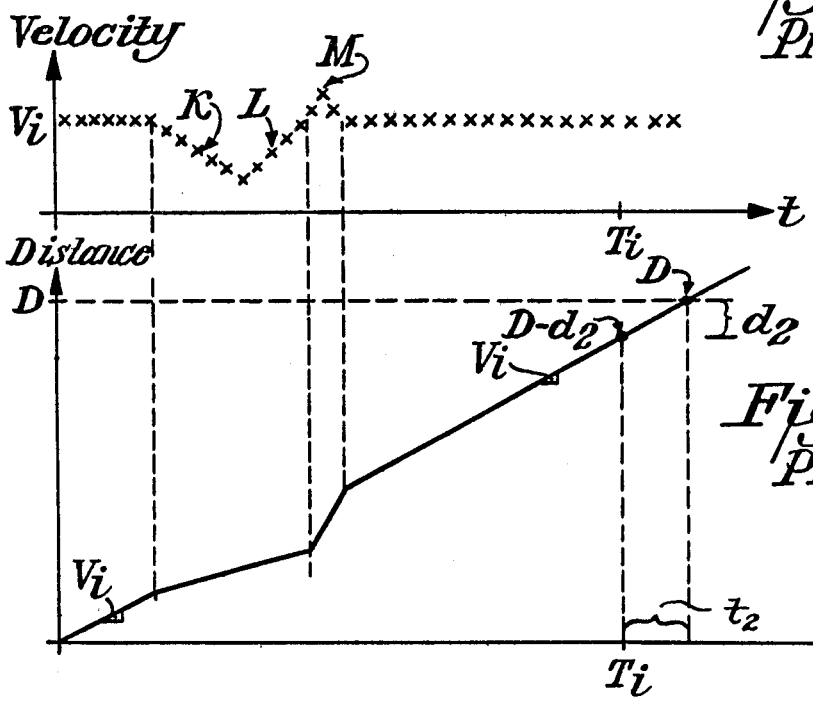
Fig. 3A. Prior Art
Fig. 3B. Prior Art

Referring to FIGS. 5 and 6, respectively, shown is a velocity-time plot of the response of the approximate automatic controller 100 to perturbations in actual film velocity similar to the velocity increase depicted in FIG. 2A and the velocity decrease shown in FIG. 3A.

Figure 2B:
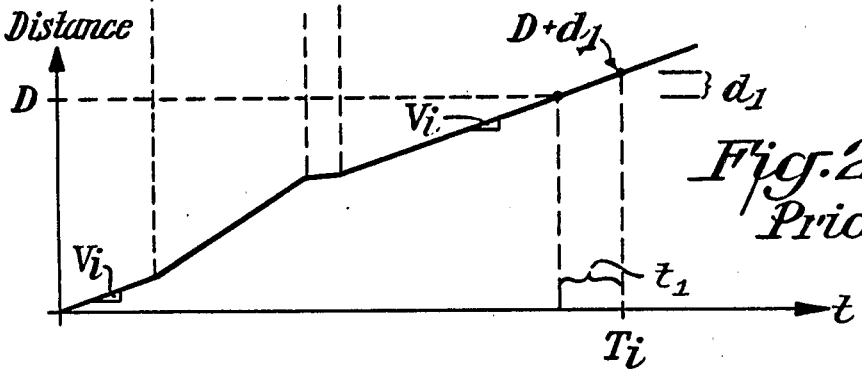
Fig. 2B. Prior Art
Figure 1A:
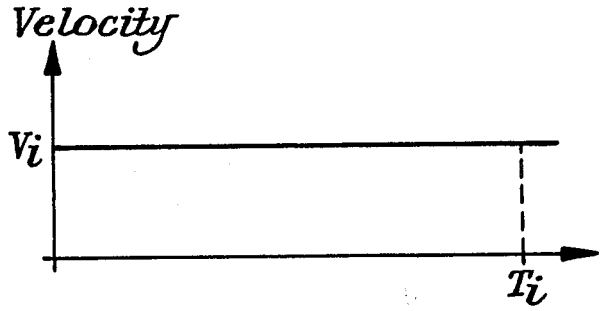
Fig. 1A. Prior Art
FIGS. 1A and 1B are ideal velocity-time and ideal distance-time plots indicating the underlying rationality for fixed velocity controllers used in the prior art.
Figure 1B:
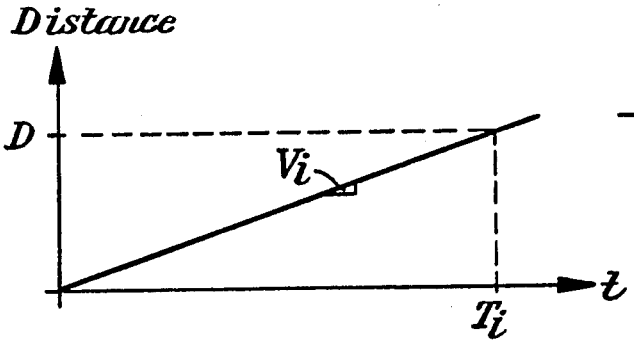
Fig. 1B. Prior Art

In FIG. 5A, in response to the occurrence of the velocity increase in the vicinity of the region F', the controller 100 acts in a manner similar to that shown in FIG. 2A to restore the actual velocity of the film to the ideal reference velocity $V_i$, as shown in the vicinity of region G'. Additionally, however, the controller 100 modifies the actual velocity of the film to compensate for the deviation in actual film position generated by the velocity perturbation. This modification is illustrated in the region indicated by the reference character H'. As a result, as seen from FIG. 5B, the corrections to the film velocity result in the film traversing the development distance D within a predetermined close time range e of the ideal development time $T_i$. Thus, position deviations (as that depicted in FIG. 2B) which occur when a fixed velocity control arrangement is utilized, are believed avoided.

In FIG. 6A, in response to a velocity decrease similar to that shown in FIG. 3A, the controller 100 initially acts in a manner similar to the controller depicted in FIG. 3A to restore the actual film velocity toward the ideal reference velocity $V_i$. This response to the perturbation in the region K' is illustrated in FIG. 6A by the character L'. Additionally, the controller 100 acts to modify the actual film velocity to compensate for the deviation in actual film position due to the velocity perturbation. The modification, shown in the region M' in FIG. 6A, results in compensation of the film velocity such that the film traverses the development distance D in a predetermined close interval e of the ideal development time $T_1$. Positional deviations as illustrated in FIG. 3B are thus believed avoided.

It should be noted in connection with both FIGS. 5A and 6A that the compensation effected by the controller 100 in the regions H' and M', respectively, is preferably distributed over a longer time interval than was required to initially restore the actual velocity to the ideal velocity. Thus, although the areas under the deviated portions of the plots (each indicated by reference character $A_d$) respectively equal the areas under the compensated portions of the plots (each indicated by the character $A_c$), controller 100 acts to make a gradualized compensation in comparison to an abrupt deviation.

Figure 7:
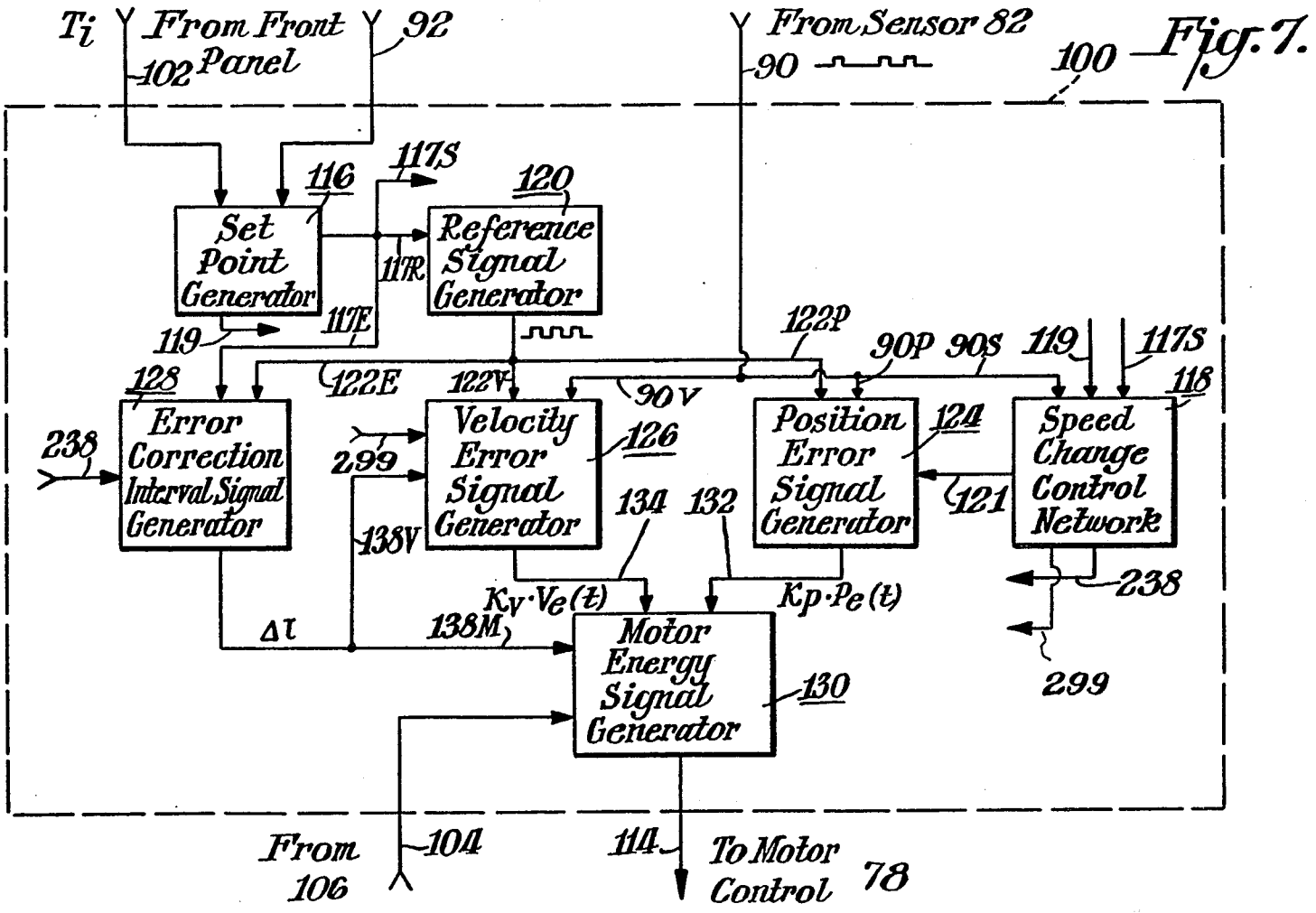
FIG. 7 is a generalized block diagram of an automatic controller of the instant invention.

FIG. 7 shows a generalized block diagram of the automatic controller 100 in accordance with the instant invention. The controller 100 includes a set point signal generator 116 and a reference signal generator 120. The selected ideal development time $T_i$ is entered into the set point generator 116 on a line 102 while the output from the generator 116 is applied over lines 117R, 117S and 117E to the reference signal generator 120, to a speed change control network 118 and to an error correction interval signal generator 128, respectively. Another output of the set point signal generator 116 is applied to the speed change control network 118 over a separate line 119.

The output of the reference signal generator 120 is connected by a line 122P to a position error signal generating network 124, by a line 122V to a velocity error signal generating network 126 and by a line 122E to the error correction interval signal generator 128. The speed change control network 118, the position error signal generator 124 and the velocity error signal generator 126 are each also input with the signals generated from the sensor arrangement 82 over lines 90S, 90P and 90V, respectively, each tied to the line 90 emanating from the sensor arrangement 82.

The output of the position error signal generator 124 and the velocity error signal generator 126 are respectively applied to a motor energy signal generator 130 on lines 132 and 134. The output of the error correction interval signal generator 128 is applied as an enabling signal to the velocity error signal generator 126 over a line 138V and over a line 138M to the motor energy signal generator 130. The output of the motor energy signal generator 130 is carried by the line 114 and is applied to the motor control network 78 for the motor 74.

As discussed earlier, it may be appreciated that the controller 100 acts as to generate a feedback signal operative not only to restore the actual velocity of the motor (and, thus, the film) to a predetermined ideal reference velocity but also to compensate for deviations (either increases or decreases) in position of the film within the processor generated as a result of the perturbations in film velocity. Since in some instances it is desirable to synchronize the application of the motor energy signal with the line current, the output from the synchronizing network 106 may be applied as an input to the motor energy signal generator 130.

The input signal on the line 102 representative of the chosen development time $T_i$ is selected by the operator of the processor through appropriate numeric keypad entries or the like and is applied to the reference signal generator 120 on the line 117R from the set point signal generator 116. Since the optimum development time $T_i$ is known for the particular film processing task, and since the development distance D along which the film is carried within the developing section 24 is also known, the reference signal generator 120 is operative to develop an electrical signal representation of the ideal position that the film should occupy along the development distance D for each incremental time unit measured from the time the film is introduced into the developing section (at point 24I) to the expiration of the optimum development time $T_i$ when the film exits the developing section (at the point 24O).

The speed change control network 118 is adapted to generate a disable signal on the line 121 to the position error signal generator if the development time setting is altered.

The position error signal generator 124 is responsive to the ideal reference position signals applied to it on the line 122P as well as the signals derived from the sensor arrangement 82. These latter signals, applied to the position error signal generator 124 over the line 90P, are representative of the measured actual position of the film within the development bath (i.e., along the development distance D).

The position error signal generator 124 is operative to generate the position error present at any given time. The position error is the difference between the measured actual film position (the signal on the line 90P) and the ideal reference position (the signal on the line 122P). Expressed mathematically, if the ideal reference position signal on the line 122P is defined as the ideal position of the film in the development bath and is representable as a time function $P_i(t)$, and if the measured actual position signal (on the line 90P) is defined as the measured actual position of the film in the development bath and is representable by the time function $P_a(t)$, then the position error function $P_e(t)$ may be defined as:

$$P_e(t)=P_i(t)-P_a(t) \quad (1)$$

where
$P_i(t)$ is the ideal position,
$P_a(t)$ is the actual position,
$P_e(t)$ is the position error.

In the position error signal generator 124, the position error signal $P_e(t)$ is appropriately scaled by a selected positional constant $K_p$ and is limited to prevent large fluctuations in the total error signal from being generated. The scaling assigns an appropriate weighting that the position error may contribute to the total error signal, while the limiting "gradualizes" the compensating response generated by the controller 100. Both the scaling constant $K_p$ and the limits are adjustably selectable.

The appropriately scaled and limited position error $K_pP_e(t)$ is applied on the line 132 to the motor energy signal generator 130. It should be noted that if the position error signal were at all times forced to zero, the time that the film remains within the development bath is exactly equal to the ideal development time $T_i$. However, since it is known that a feedback system utilizing only position error control is unstable (since such a system causes continuous velocity perturbations), the controller of the instant invention does not rely solely upon the position error signal $P_e(t)$ in generating the motor energy signal.

The velocity error signal generating network 126 utilizes the same position information as is applied to and utilized by the position error signal generator 124. In the case of the velocity error signal generator 126, the measured actual position signals are applied over the line 90V while the ideal position signals are applied over the line 122V. Since velocity is defined as the rate of change of position, and since velocity error is the rate of change of position error, it is possible to generate an electrical signal representation of the velocity error by ascertaining the position error at a given instant of time and comparing that position error with the position error existing at a predetermined time increment ($\Delta T$) later.

In accordance with this invention, the velocity error signal generator network 126 is operative to generate a signal functionally related to the difference between the position error existing at a given instant of time and the position error existing at a given time increment later. Mathematically, the velocity error may be defined as:

$$V_e(t)=(\text{Position Error}/\Delta\text{Time}) \quad (2)$$

where
Position Error is the change in position error,
$\Delta$Time is the time interval over which the position error change is measured,
$V_e(t)$ is the velocity error.

Additionally, the velocity error signal generator 126 is operative to appropriately scale the velocity error signal by a selected velocity constant $K_v$ and to limit the velocity error. The scaling and limiting are performed for the same purpose as discussed in connection with the position error signal. The appropriately scaled and limited velocity error signal is applied over the line 134 to the total motor energy signal generator 130.

The time interval $\Delta T$ against which the position errors are compared to define the velocity error signal is derived from the error correction interval signal generator 128. The output of the error correction interval signal generator 128 is applied to the velocity error signal generator 126 over the line 138V. The error correction interval signal generator 128 operates to define what are, in effect, the boundaries of the time interval $\Delta T$ over which the change in positional errors are compared. The time interval $\Delta T$ may be any predetermined time increment and may be determined with or without input from the reference signal generator 120. For example, a fixed oscillator or clock may apply enabling signals to the velocity error generator 126 to generate the velocity error therein. However, in the generalized embodiment of the invention shown in FIG. 7, the duration of the error correction time interval is related to the particular ideal development $T_i$ selected by the operator. This accounts for the interconnection, over the line 117E, of the output of the set point generator 116 to the error correction interval signal generator 128.

It should be noted with regard to velocity error that if the velocity error is forced to zero, the motor being controlled is neither gaining nor losing position with respect to a reference. Although a velocity control system is stable, since the velocity error signal, in and of itself, is indicative only of the fact that the position error is not changing, the instant invention does not rely solely upon the velocity error in generating the motor energy signal.

In accordance with the instant invention the motor energy signal generator 130 is operative to first generate a total motor error signal $E_m(t)$. The total motor energy signal is functionally related to both the scaled position error signal $K_p \cdot P_e(t)$ carried on the line 132 from the position error signal generator 124 and to the scaled velocity error signal $K_v \cdot V_e(t)$ output from the velocity error signal generator 126 and carried on the line 134.

Expressed mathematically, the total motor error signal is defined as:

$$E_m(t)=K_pP_e(t)+K_vV_e(t) \quad (3)$$

where
$K_p \cdot P_e(t)$ is the scaled position error,
$K_vV_e(t)$ is the scaled velocity error, and
$E_m(t)$=total motor error signal.

The relative values of the scaling factors $K_p$ and $K_v$ are adjustably selectable, with the particular relationship between these factors determining the overall stability of the motor control and the relative weighting to be accorded to the position error and to the velocity error in determining the total motor error signal. In the preferred embodiment, $K_v$ is selected to be eight times as large as $K_p$, thus making the motor control system more responsive to velocity error and thereby making the motor control system very stable.

The motor energy signal generator 130 is also operative to integrate (or sum over time) the values of the total motor error signal to generate a motor energy signal. The motor energy signal produced by the accumulation over time of the total motor error signals is a measure of how much of the available energy from the source that will be permitted to be applied to the motor through the motor control 78. The summation of the total motor error signals, in response to enabling signals applied over the line 138M from the error correction interval signal generator 128, results in the generation of the motor energy signal.

The motor energy signal carried on the line 114 from the signal generator 130 is operative to correct the drive motor velocity in such a manner that not only is the speed of the film returned to the predetermined ideal reference velocity $V_i$ but also the motor speed is altered so that deviations from the ideal film position are compensated.

The motor energy signal may be utilized in any suitable manner to effect the control of the drive motor in order to compensate for the loss of film position due to velocity perturbations. The motor energy signal may, for example, be utilized to modulate the amplitude of line signals to thereby vary the power delivered to the motor drive. Alternatively, the motor energy signal may be used to generate a voltage threshold above which no line power is delivered. In the preferred embodiment, as discussed herein, the total motor error signal is periodically applied to very the phase angle at which the SCR (disposed within the motor control 78) is triggered to deliver to the motor only the power remaining in each rectified half cycle of line signal. Of course, the listing of these possible applications modes of the total motor error signal is to be construed in an illustrative, and not a limiting, sense.

In the preferred embodiment it is desirable to periodically apply the motor energy signal to the motor control. To effect this purpose, an enabling inut on the line 104 from the interrupt network 106 is applied to the motor energy signal generator 130. When enabled by the occurrence of the interrupt which occurs at each zero crossing of the rectified line signal, the motor energy signal is applied to the motor control 78.

The speed change control network 118 operates in response to an operator-initiated change in the development time $T_i$ input to the controller 100 from the front panel. A change in development time is effective only for the processing of the next-subsequent film entering the processor following the change. The network 118 disables the position error signal generator for a predetermined time to permit a smooth and rapid change in speed. Thereafter, the network 118 enables the position error signal generator 124.

Although the invention may be implemented in either analog or digital modes and in either hardwire circuitry or program controlled circuitry the best mode contemplated for the implementation of the instant invention is a firmware-based microcomputer. Suitable for use within the controller 100 is a single board computer such as that manufactured by Intel sold under model number SBC 8005 that includes a central processor unit such as an Intel 8085 single chip eight-bit, N channel microprocessor, a system clock, a random access memory such as that manufactured by Intel and sold under model number 5101, a read-only memory such as that manufactured by Intel and sold under model number 2716, input-output ports, a programmable timer, an interrupt and bus control logic adapted to control the flow of information between the above-recited constituent elements of the microcomputer. Extended memory capability may be provided on a separate printed circuit board on which is also disposed the random access memory, the read-only memory as well as the bus control logic.

The architecture of the microcomputer utilized is configured in accordance with the principles set forth with documentation supplied by the manufacturer of the SBC 8005 single board computer and the 8085 microprocessor chip along with vendor's product specification. These materials include: (1) the TTL Data Book for Design Engineers, Second Edition, Texas Instruments, 1976; (2) RCA Solid State 1974 Data Book, Series SSD-201B, Linear Integrated and MOS Devices Selection Guide Data, RCA, 1973; and (3) Intel Component Data Catalog, Intel Corporation, 1979.

Figure 8B:
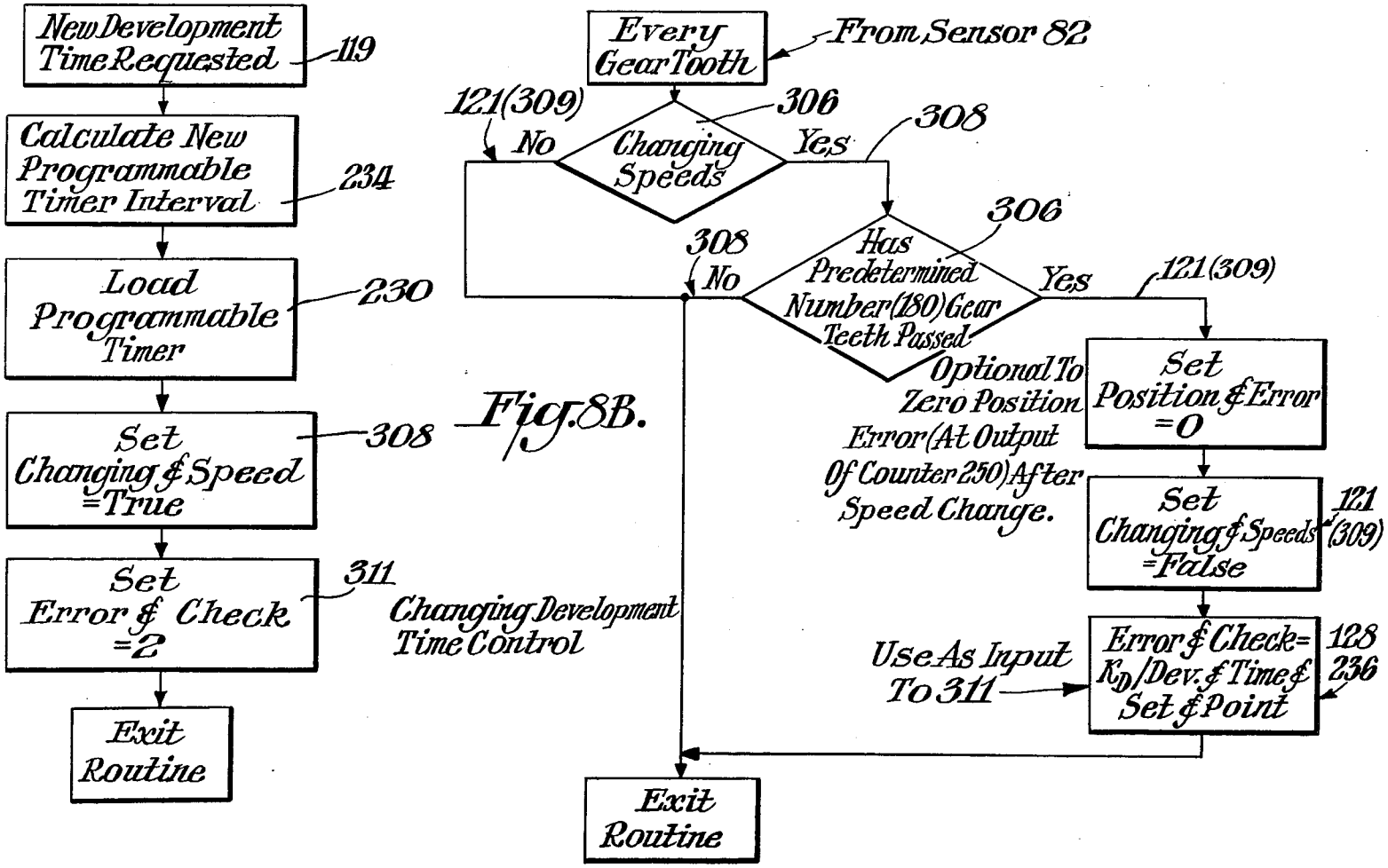

With reference to FIGS. 8A and 8B, shown is a flow chart of a program in accordance with which the microcomputer may implement the functions discussed above in connection with the generalized block diagram of FIG. 7. The flow chart of FIG. 8 is also keyed by the appropriate reference numerals to indicate the function performed in the microcomputer corresponding to the hardware components shown in FIG. 9. A program listing of a program in accordance with the flow diagram of FIGS. 8A and 8B is appended to and made part of this application.

With reference to FIG. 9, shown is a more detailed diagram of a hardwire implementation in the digital mode of the controller 100 in accordance with the instant invention.

Disposed on the front control panel of the film processor is a numeric key pad 202 into which the operator may select the desired ideal development time for a particular film processing task. The ideal development time $T_i$ may be adjusted to any time setting (with one second resolution) between a predetermined lower development time (on the order of thirty seconds) to a predetermined upper development time (for example, 6 minutes). The setting of the numeric key pad is converted to a digital form and is applied over the bus 102 to the set point signal generator 116.

The set point signal generator 116 includes a multiplexer 208 to which is applied the digital representation of the ideal development time signal $T_i$ on the bus 102 and a signal representation of a predetermined standby development time on a bus 210. The standby development time is utilized as the "ideal" input to the processor during those intervals (called "standby mode") when the processor drive is running, yet no film is being conveyed through the processor. The multiplexer 208 selects either the development time dialed by the operator (on the bus 102 or the standby development time (on the bus 210) in accordance with the state of a signal on a line 214 output from an up-down counter 216. The counter is arranged such that entry of a film past the film entry switch 54 (FIG. 4) increments the counter 216 and the exit of a film from the processor decrements the counter 216. Information regarding the entry and exit of a film from the processor is applied to the counter 216 on the lines 92 (from the switch 54 and the circuit equivalent of a switch positioned as the switch 55). Thus, when film is being processed (the "process mode"), the counter output is not equal to a zero count, and the multiplexer is asserted over the line 214 to select the development time setting selected by the operator.

Conversely, when counter 216 output is equal to zero count, the multiplexer is enabled to select the preset standby development time signal.

The operator-selected development time signal passes the multiplexer 208 and is applied by a bus 218 to a latch 220 and to one side of a digital comparator 222. The latch output is applied to the other side of the comparator 222 on a bus 224. The latch 220 is enabled by a signal derived from the "not-equal" output of the comparator 222 on a line 226. If, during the process mode, the operator modifies the ideal development time $T_i$, the comparator 222 generates a "not-equal" signal indicating that the newly-selected development time is different from the previous development time latched into the latch 220. The signal on the line 226 latches the then-current development time for later comparison. The line 226 is also connected over the line 119 to the speed change control network 118. The then-current development time $T_i$ (if in process mode) or the standby development time (if in standby mode) is applied to the reference signal generator 120, to the error correction interval signal generator 128 and the speed change control network 118 on the nine-bit data bus lines 117R, 117E and 117S, respectively.

Within the reference signal generator 120 the representation of the ideal development time $T_i$ on the bus 117R is utilized to develop a pulse train carried by the line 122 representative of the ideal output that would be produced from a sensor arrangement (such as an arrangement similar to the arrangement 82) of a processor operating at an ideal velocity, that is, a velocity sufficient to traverse the development distance D in exactly the optimum development time $T_i$. The pulse train output on the line 122 is developed from a programmable timer 230 which receives its input from a digital clock 232. The timer 230 modulates the clock output in accordance with a signal conditioning network 234. The conditioning network 234 generates a signal that is some appropriate multiple or percentage of the ideal development time. The value of the multiple is selected in accordance with the frequency of the clock 232, the length of the development distance D calibrated in sensor gear teeth, and the ideal development time $T_i$. The output of the reference signal generator is the pulse train representative of the position signals which would be generated by a processor operating on schedule with the selected development time.

The reference time $T_i$ signal carried on the bus 117E is applied to the error correction interval signal generator 128. The generator 128 includes a digital divider 236 which subdivides the ideal development time interval $T_i$ into a predetermined number of equal segments. The number of the segments is controlled by a selectable constant $K_D$ signal 238 applied to the divider 236. The output of the divider 236 is applied over a eight-bit data bus 240 to a digital comparator 242. The output on the lines 240 is representative of that number of ideal pulses that an ideal processor would generate during an incremental segment of the ideal development time $T_i$. The ideal pulse train output from the programmable timer 230 is applied over the line 122E to the down input of the counter 242. When this counter decrements to zero an enable pulse is generated and applied over the lines 138 to the velocity error signal generator 126 and to the motor energy signal generator 130. The signal also causes the counter 242 to reload with the output of the divider 236 carried on the bus 240. The occurrence of each enable pulse on the line 138 serves to define a predetermined known time interval $\Delta T$ against which velocity error can be determined and the motor energy signal generated.

The position error signal generator 124 is a network which generates a "raw" position error. This network includes a sixteen-bit, two's complement up-down arithmetic counter 250 having applied thereto the signals on the line 122P representative of the ideal pulse train and the measured actual processor pulse train signals on the line 90P. (Since in the preferred embodiment the "raw" position error is utilized by both the position error signal generator and the velocity error signal generator 126, the input lines to the counter 250 are indicated by using both the characters 122P/122 V and 90P/90 V). Each positive-going transition of the signal on the line 122P increments the counter 250. Each positive transition of the pulses on the train on the line 90P decrements the counter 250. The resultant output of the counter 250 is representative of the "raw" position error between the measured actual ideal film position of the film (as represented by the pulses on the line 90) as compared to the ideal film position in an ideal processor (as represented by the pulses on the line 122). If the output from the counter 250 is a positive number the actual position of the film within the processor is behind or lagging desired ideal position. Conversely, if the output of the counter 250 is a negative number the actual position of the film within the processor is ahead or leads the ideal film position. Of course, if the counter output is zero, there is no position error within the system.

The magnitude of the "raw" position error from the counter 250 is applied over a sixteen-bit data bus 252 to an allowable error threshold network 254. The network 254 includes a multiplexer 256 asserted by the sign bit from the output of the counter 250, and an adder 258. The network 254 conditions the "raw" position error signal by adding an appropriate constant value to the output signal from the counter 250 (depending upon the input of the multiplexer selected) thereto. The output of the network 254 is applied by a bus 260 to a divider 262. The appropriate signal value added within the network 254 to the "raw" position error signal is selected such that an integer output is produced from the divider 262 only if the raw position signal exceeds a predetermined threshold. The threshold is, of course, selectable.

The divider 262 scales the conditioned "raw" position error signal in accordance with a position constant $K_p$, selected to appropriately weight the impact that the position error will have on the total motor error signal. The output of the divider 262 is applied over a bus 264 to a limiter 266. The limiter 266 serves to gradualize the response of the controller by permitting only scaled position errors lying within predetermined upper and lower limits to pass. The upper and lower limits are applied to the limiter 266 over lines 270H and 270L. The output of the limiter 266 is applied over an eight-bit data bus 272 to a latch 276 which is normally maintained in an enabled condition by a line 121 emanating from the change speed control network 118. The output from the latch 276 is conducted by the bus 132 and constitutes the scaled position error signal $K_p \cdot P_e(t)$.

The output on the bus 252 representative of the "raw" position error (the count difference between the measured actual and the ideal machines) is applied over buses 282A and 282B to a sixteen-bit latch 284 and to a digital subtractor 286, respectively. The latch 284 is enabled by a signal on a line 138V-1, derived from the error correction interval signal and applied on the line 138V. A delay network 292 is interposed between the error correction interval signal generator 128 in the line 138V-1 and one input of a normally open an enabling gate 294. The raw position error signal present on the bus 282A is latched into the latch 284 upon the occurrence an error correction interval signal on the line 138V-1. Thus, the "raw" position error presented at input of the latch 284 appears at the output of the latch at the occurrence of each enable signal. At the occurrence of the next-following error correction signal (at a time $\Delta T$ later) applied over the line 138V-2 to the subtractor 286 the magnitude of the "raw" position error then-present on the bus 282B is reduced by the value of the previous "raw" position error presented to the subtractor 286 from the output of the latch 284. Thus, the subtractor 286 generates a signal representative of the change in position error between two successive error correction interval signals occurring a time $\Delta T$ apart. (Once the subtraction is made, the delay line 292 passes the second error interval signal to latch the then-current "raw" position error signal in anticipation of the next error correction interval signal).

The output of the subtractor 286 is applied over a bus 295 to a digital divider 298. The digital divider 298 appropriately scales the output of the subtractor 286 (which represents the "raw" velocity error) by a factor $K_v$ applied on a bus 299 selected in accordance with the desired weight to be accorded the velocity error in the generation of the total motor error signal. The output of the divider 298 (the scaled velocity error signal) is carried by a bus 300 to a comparator 302.

The comparator 302 permits the latch 284 to be enabled by the delayed signal on the line 138V-1 only if a scaled velocity error is output from the divider on the bus. If the scaled velocity error is substantially equal to zero (i.e., there is zero position error or the position error is within one tooth (phase error)) the output from the comparator 302 on the line 305 disables the gate 294 and prevents the passage of the delayed signal on the line 138V-1. Thus, the then-current value of the position error (on the bus 282A) is latched into the latch 284 only if a scaled velocity error is present.

The output representative of the scaled velocity error signal $K_p \cdot V_e$ (t) is conveyed over the bus 134 to the motor energy signal generator network 130.

The change speed control network 118 derives its inputs from the sensor 82 on the line 90S, and from the set point signal generator 116 on the bus 117S and the line 119. The signal on the line 119 indicates that the development time $T_i$ has been changed. A down counter 306, having a fixed position value signal P on a bus 307 (typically one hundred eighty) and the measured actual position on the line 90S applied thereto is enabled by the signal on the line 119. If the value of the output of the counter 306 is not equal to zero, a signal is present on the line 308, while if the counter 306 output is zero, a signal is present on the line 309.

A signal on the line 308, a "changing speeds" condition, asserts multiplexers 310 and 311 to select the "B" inputs thereto. Thus a predetermined $K_v'$ value (less than the normally applied value of $K_v$) is output on the bus 299 to the divider 298 in the velocity error signal generator 126. The multiplexer 311 outputs a signal on the bus 238 to the divider 236 in the error correction interval signal generator 128. The value at the "B" input of the multiplexer 311 (that is applied as the constant $K_D'$ on the bus 238) is a scaled signal representation of the ideal development time $T_i$ applied over the bus 117S. The signal on the bus 117S is appropriately multiplied by a selected value in a multiplier 312. The selected value is typically two.

A signal on the line 309 from the counter 306 is a "not changing speeds" condition, is indicated on the line 121 maintaining the latch 276 enabled. The "A" inputs of the multiplexer 310 and 311 are asserted and the normal values of $K_v$ and $K_D$ are respectively applied over the buses 299 and 238.

The effect achieved by the change speed network 118 is to provide a smooth, rapid change in speed of the film. Circuitry may also be provided if it is desired to prevent changing speed while film is within the developing section 24, even if the operator changes the ideal development time $T_i$. With such a circuit, only after the trailing edge of the last piece of film exits the development distance D will the new value of $T_i$ be authorized.

The motor energy signal generator 130 includes an adder 320 which sums the appropriately scaled position error signal on the bus 132 with the appropriately scaled velocity error signal on the bus 134. The output of the adder 320, carried on the bus 324, represents the total motor error signal $E_m(t)$. The total motor error signals, when integrated or summed over time produce the motor energy signal that is applied to the motor to bring the speed of the motor and the position of the film to the ideal values.

To produce the motor energy signal, the current total motor error signal on the bus 324 is applied to an adder 326 and summed with the previous motor error signal that is stored in a latch 328. The latch 328 is enabled through a delay 330 by the output from the error correction interval generator 128 on the line 138M-1. The motor energy signal is updated during each error correction interval when the adder 326 is enabled by the signal from the correction interval generator 128 on the line 138M-2.

The current motor energy signal produced at the output of the adder 326 is applied over a bus 332 to a digital limiter 334. The limiter 334 serves to gradualize the motor response by maintaining the motor signal signal to within predetermined high and low limits applied to the limiter over buses 336L and 336H. The output of the limiter 334 is carried on a bus 344 and is the motor energy signal. Depending upon the particular processor with which the controller 100 is used, this signal may be used to appropriately modify the energy delivered to the motor by any of the methods (among others) outlined above. The output of the limiter 334 is fed back to the latch 328 by a feedback bus 342.

In connection with the instant invention it is desirable and preferred that the current motor energy signal be applied in synchronization with the line signal applied to the motor.

To effect this purpose a latch 346 is connected to receive the output on the bus 344. The latch 346 is enabled by an output on the line 104 derived from a zero crossing interrupt network 106 which monitors the zero crossings of the rectified 60 Hertz line signal. The output of the latch is carried by a bus 350 to a counter 352. When enabled by the output on the line 104 the then-current motor energy signal is applied to the counter 352. The counter 352 is an eight-bit counter and serves to subdivide the 8.333 milisecond period of the rectified, half-cycle, 60 Hertz signal into two hundred fifty-six equal 32.555 microsecond intervals from a clock 353. The count applied to the counter 352 represents the delay between zero crossing and the time the SCR in a network 370 is fired.

Figure 9A:
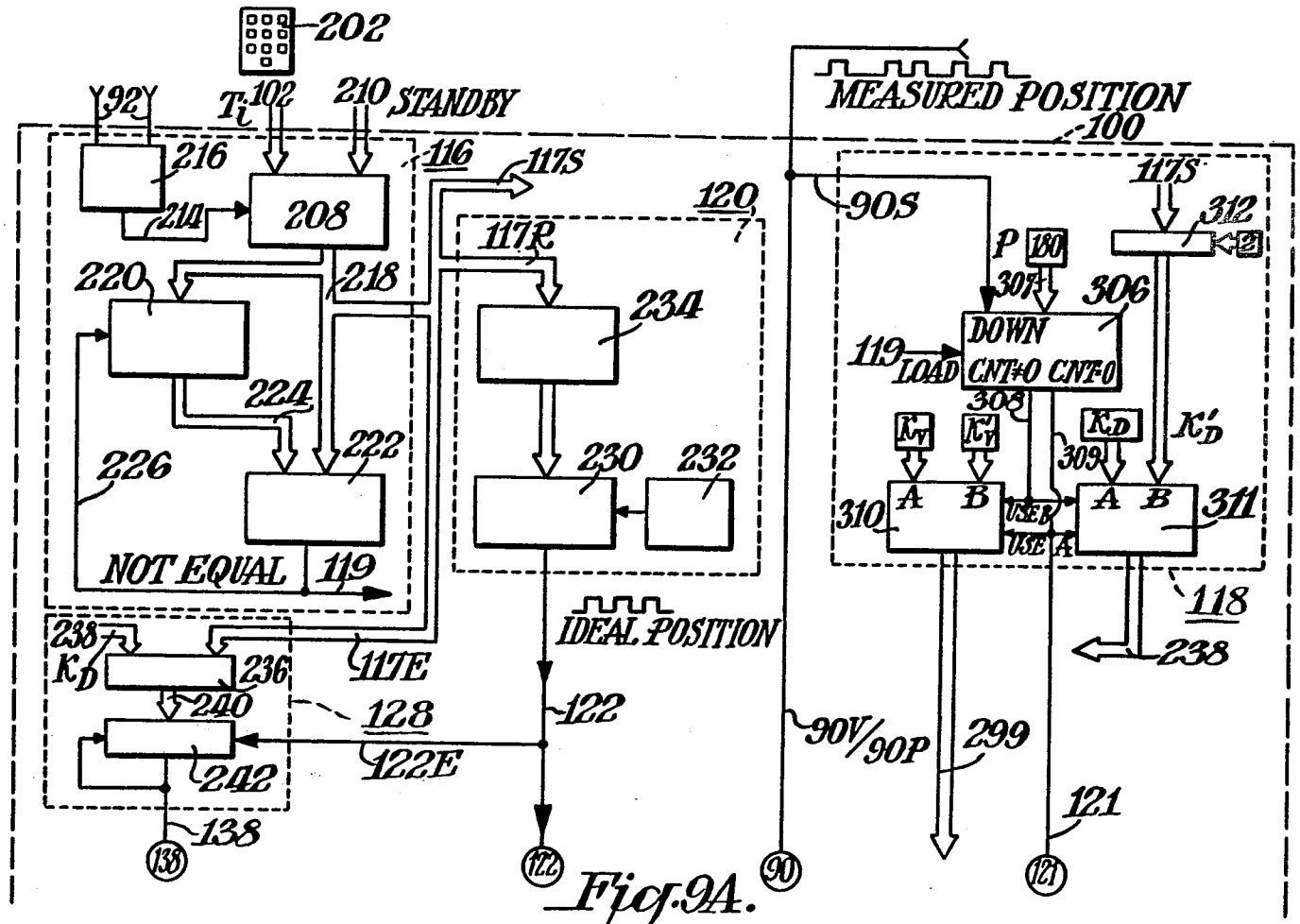
FIGS. 9A and 9B are a diagram illustrating a hardwire implementation of the invention; and The Appendix, attached to this application and made part hereof, is a listing of a program in accordance with the flow chart of FIGS. 8A and 8B.
Figure 9B:
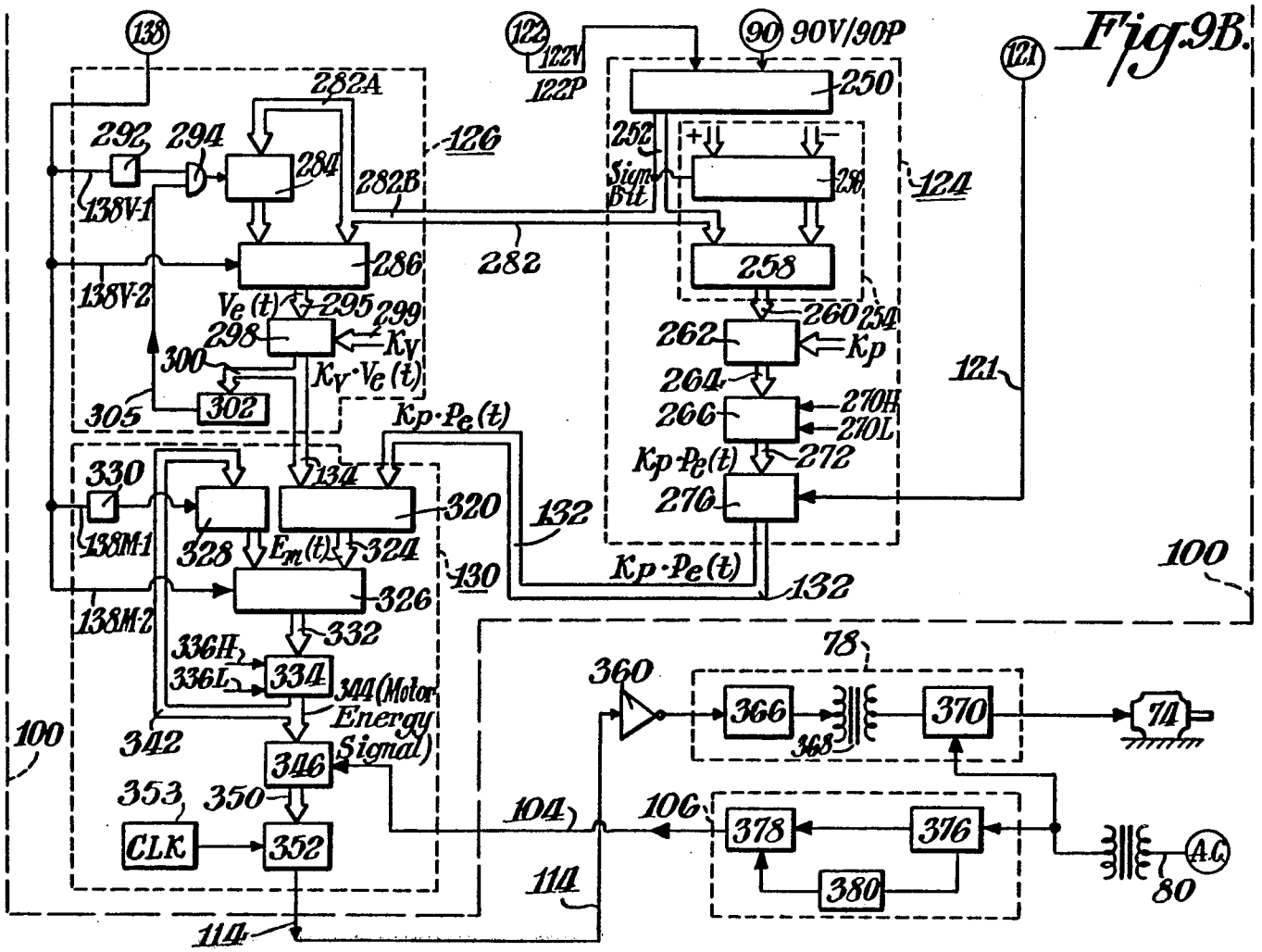

Following is a tabularized listing of suitable hardware elements which may be utilized to implement the circuit set forth in FIGS. 9A and 9B. Where indicated by an asterisk, each of the circuit elements (listed by reference numeral) may be obtained from any component manufacturer (e.g., Texas Instruments, Fairchild, Signetics, National Semiconductor, Motorola) under the listed component number(s). Otherwise the preferred manufacturer and component number is set forth. As is known to those skilled in the art, a number of such devices may have
to be combined to produce the desired function, depending upon the number of bits, etc.

| Element | Manufacturer | Component Number |
|---|---|---|
| Multiplexer 208,256 310,311 | * | combinations of 7408, 7432 |
| Counter 216,250 306 | * | 74193 |
| Counter 352 | RCA | 4029B |
| Latch 220, 276 284, 328 346 | * | 7475 |
| Comparator 222 | * | 7485 |
| Comparator 242 | * | 74193 |
| Divider 236,262 298 | * | 74198 |
| Adder 258,320 326 | * | 74181 |
| Limiter 266, 334 | * | 7408, 7485 |
| Subtractor 286 | * | 74181 |
| Programmable Timer 230 | * | 8155 |
| Multiplier 312 | * | 74274 |
| Delay (one hundred fifty nanosecond) 292, 330 | * | 74221 |
| AND Gate 294 | * | 7408 |

In the preferred embodiment, the pulse signal from the counter 352 is applied on the line 114 to a power inverter 360 located on an input/output interface. The inverter 360, such as a Sprague LLLN 2015 power inverter, inverts the signal and drives transistors (each 2N3904, not shown) disposed in a network 336 located in the motor control 78. The network 366 includes a filter, a threshold level detector and a pulse driver. The output of the pulse driver is coupled to a pulse transformer 368, the secondary of which is coupled to the gate electrodes of SCR's (each 2N4444) in the network 370. A current signal of sufficient magnitude will turn the SCR's "on" and the SCR's will remain on until disabled by a signal from the zero crossing detector network 106. The SCR's remain "off" until fired by a subsequent pulse from the counter 352.

The zero crossing detector network 106 includes a zero crossing detector 376, as an RCA CA 3059, which outputs a pulse each time the stepped down line voltage crosses the zero point. This pulse turns "on" an optical isolator 378, as a Hewlett-Packard 6N139. The output of the isolater 378 enables the latch 346 over the line 104. The falling edge of the zero crossing pulse from the detector 376 fires a one-shot 380, as a 74C221, disabling the isolator for a predetermined time (approximately eight milliseconds), thereby preventing noise from triggering the latch 346 before the next crossing.

In view of the foregoing, it may be appreciated that in accordance with the instant invention an automatic processor controller has been provided which generates a total motor error signal functionally related to both the position error and the velocity error. The total motor error signal is integrated and generates a motor energy signal which, when applied to the motor, modifies the amount of energy that is permitted to be applied to the motor drive. Thus, the motor is not only corrected for velocity deviations, but also compensated to overcome position deviations.

Although those skilled in the art, having benefit of the teachings of the instant invention may implement the invention by alternate equivalent means, such alternates are to be constructed as lying within the scope of this invention, as defined in the appended claims.

What is claimed is:

1. In a film processor including transport rollers for transporting a film through the processor, a drive motor coupled to drive the transport rollers, a network including a sensor for generating signals representative of the actual velocity and of the actual position of the film, a network for generating reference signals representative of the ideal velocity and of the ideal position of the film, and a motor control network for controlling the application of power from a source to the motor, wherein the improvement comprises:

an automatic controller comprising:

a velocity error signal generator for generating a velocity error signal functionally related to the difference between the actual velocity signal and the reference velocity signal;

a position error signal generator for generating a position error signal functionally related to the difference between the actual position signal and the reference position signal; and, a motor energy signal generator for generating a total motor error signal that is functionally related to the sum of the velocity error signal and the position error signal and for generating a motor energy signal by summing the total motor error signal over time, the motor energy signal being applicable to the motor control network to apply a portion of the available energy from the source to the motor to restore the actual position of the film to within a predetermined range of the ideal position and to restore the actual velocity of the film to within a predetermined range of the ideal velocity to compensate for deviations in actual film position and in actual film velocity following a velocity perturbation.

2. The film processor of claim 1 wherein the source provides an alternating current signal, further comprising:

means responsive to the occurrence of each zero crossing of the alternating current signal for applying the motor energy signal to the motor control network.

3. The film processor of claim 2 wherein the automatic controller comprises a firmware-based microcomputer operating in accordance with a program.

4. In a film processor including transport rollers for transporting a film through the processor, a drive motor coupled to drive the transport rollers, a sensor for generating a signal representative of the actual position of the film, a network for generating a reference signal representative of the ideal position of the film, and a motor control network for controlling the application of power from a source to the motor, wherein the improvement comprises an automatic controller which comprises:

a position error signal generator responsive to the actual position signal and to the reference signal for generating a position error signal functionally related to the difference therebetween;

a velocity error signal generator responsive to the position error signal for generating a velocity error signal functionally related to the change in position error during a predetermined time interval;

a motor energy signal generator for generating a total motor error signal functionally related to the sum of the velocity error signal and the position error signal and for generating a motor energy signal by summing the total motor error signals present at the beginning and end of the predetermined time interval; and, means for applying the motor energy signal to the motor control network to apply a portion of the available energy from the source to the motor to restore the velocity of the film to within a predetermined range of an ideal film velocity and to restore the actual position of the film to within a predetermined range of an ideal position to compensate for deviations in actual film position following a perturbation.

5. The film processor of claim 4 wherein the source is an alternating current source and wherein the applying means is responsive to the occurrence of each zero crossing of the alternating current signal.

6. The film processor of claim 4 wherein the position error signal generator and the velocity error signal generator each respectively includes means for scaling the position error signal by a first predetermined constant and means for scaling the velocity error signal by a second predetermined constant.

7. The film processor of claim 6 wherein the source is an alternating current source and wherein the applying means is responsive to the occurrence of each zero crossing of the alternating current signal.

8. The film processor of claims 4, 5 or 7 wherein the automatic controller comprises a firmware based microcomputer operating in accordance with a program.

9. The film processor of claim 6 wherein the position error signal generator and the velocity error signal generator each respectively includes means for limiting the scaled position error signal and means for limiting the scaled velocity error signal to gradualize the effect of the controller.

10. The film processor of claim 6 wherein the second predetermined constant for scaling the velocity error signal is greater than the first predetermined constant for scaling the position error signal.

11. A method for controlling a motor driving a film through a processor comprising the steps of:

(a) generating a velocity error signal functionally related to the difference between the actual velocity of the film and a predetermined reference velocity;

(b) generating a position error signal functionally related to the difference between the actual position of the film and a predetermined reference position;

(c) generating a total motor error signal by combining the position error signal and the velocity error signal;

(d) generating a motor energy signal by summing the total motor error signal over time; and, (e) applying the motor energy signal to the motor to modify the portion of the available energy from a source which is applied to the motor.

12. The method of claim 11 wherein the source outputs an alternating current signal and wherein the step (e) is performed in accordance with the occurrence of the zero crossing of the alternating current signal.

* * * * *